US010193289B1

(12) United States Patent
Peng

(10) Patent No.: US 10,193,289 B1
(45) Date of Patent: Jan. 29, 2019

(54) PLUG-IN POWER SOURCE ADAPTING SEAT

(71) Applicant: Rich Brand Industries Limited, Dongguan, Guangdong Province (CN)

(72) Inventor: Te-Shui Peng, Taoyuan (TW)

(73) Assignee: Rich Brand Industries Limited, Guangdong Province (CN)

( * ) Notice: Subject to any disclaimer, the term of this patent is extended or adjusted under 35 U.S.C. 154(b) by 0 days.

(21) Appl. No.: 15/987,022

(22) Filed: May 23, 2018

Related U.S. Application Data

(63) Continuation-in-part of application No. 15/830,518, filed on Dec. 4, 2017, now Pat. No. 10,116,109.

(51) Int. Cl.

| | |
|---|---|
| ***H01R 33/94*** | (2006.01) |
| ***H01R 4/48*** | (2006.01) |
| ***H01R 33/22*** | (2006.01) |
| *H01R 31/06* | (2006.01) |
| *H01R 24/54* | (2011.01) |
| *H01R 33/945* | (2006.01) |

(52) U.S. Cl.
CPC ..... *H01R 33/94* (2013.01); *H01R 4/48* (2013.01); *H01R 33/22* (2013.01); *H01R 24/54* (2013.01); *H01R 31/06* (2013.01); *H01R 33/9453* (2013.01)

(58) Field of Classification Search
CPC ..... H01R 24/54; H01R 31/06; H01R 33/94; H01R 33/9453; H01R 33/22
USPC ..... 439/638, 641, 667, 665
See application file for complete search history.

(56) References Cited

U.S. PATENT DOCUMENTS

| | | | | |
|---|---|---|---|---|
| 7,387,544 | B1 * | 6/2008 | Hsu | H01R 13/6397 439/300 |
| 7,407,418 | B1 * | 8/2008 | Harlan | F21V 19/00 439/641 |
| 2011/0021081 | A1 * | 1/2011 | Lin | H01R 33/94 439/641 |

* cited by examiner

*Primary Examiner* — Abdullah Riyami
*Assistant Examiner* — Justin Kratt
(74) *Attorney, Agent, or Firm* — Alan D. Kamrath; Kamrath IP Lawfirm, P.A.

(57) ABSTRACT

A plug-in power source adapting seat can be screwed into the screwing portion of a conventional lamp seat to achieve a screwing combination together with the conventional lamp seat, and power is conducted to the power source adapting seat. The power source adapting seat can be plugged by power lines of other electric appliances to supply power to the other electric appliances. At the same time, when two naked ends of the power line are plugged and conducted for the power source adapting seat, both are respectively and stably clamped by two clamp line ends, so that the power line is unable to randomly come off. Moreover, it is difficult to loose and separate even if an external force is imposed thereon.

4 Claims, 6 Drawing Sheets

PLUG-IN POWER SOURCE ADAPTING SEAT

CROSS REFERENCE TO RELATED APPLICATIONS

This application is a continuation-in-part of U.S. patent application Ser. No. 15/830,518 entitled "Threaded lamp socket conversion connector" and filed on Dec. 4, 2017.

BACKGROUND OF THE INVENTION

Field of the Invention

The present invention relates to a plug-in power source adapting seat and, more particularly, to a plug-in power source adapting seat capable of achieving the purposes of providing a screwing combination and conducting power together with a conventional lamp seat.

Description of the Related Art

Recently, the whole world fully supports energy saving and carbon reduction, especially for the illumination field. Energy saving fluorescent light bulbs and LED light bulbs are developed and widely used to replace conventional tungsten light bulbs having power consuming and low efficiency shortcomings. However, an interface inconsistency problem must be taken into account while using energy saving light bulbs to replace original incandescent lamps. The conventional incandescent lamps are mostly incorporated with screw thread interfaces, such as an E26/E27 model number. This screw thread interface has huge inventories, since it has been in the market for a long time. The current energy saving lamps often adopt plug-in (non-screw thread) interfaces that are unable to connect with the conventional screw thread interfaces. If existing screw thread interfaces are completely replaced with new plug-in interfaces, enormous waste may occur. Moreover, the replacement of this interface requires professional persons to carry out, and normal consumers may not handle the replacement.

SUMMARY OF THE INVENTION

In view of the aforementioned drawbacks of the prior art, a primary objective of the present invention is to provide a power source adapter capable of achieving the purposes of providing a screwing combination and conducting power together with a conventional lamp seat. Moreover, the power source adapter can be further provided to be plugged and conducted by power lines of other electric appliances to supply power to the other electric appliances.

It is a secondary objective of the present invention to provide a plug-in power source adapter seat capable of fastening and inserting the power line and that is difficult to loose and separate even if an external force is imposed thereon.

To achieve the above mentioned objectives, the present invention provides a plug-in power source adapting seat composed of a main body, an adapting barrel, a positive pole clip, a negative pole clip and a joining body. The main body is integrally formed by a cylinder like portion and a disc like portion. The cylinder like portion has a straight-type external surface, the top surface of the cylinder like portion is opened, and an inside of the cylinder like portion is disposed with a positive pole clip slot and a negative pole clip slot. An outward appearance of the cylinder like portion is formed with a shield ring at a small distance away from a bottom of the cylinder like portion, the bottom of the cylinder like portion is circularly disposed with a plurality of slots, and a circumference wall is disposed with a notch. The disc like portion is formed at the bottom of the cylinder like portion and is formed with an expanded area. The bottom of the disc like portion is formed with a set of inserting troughs, with each inserting trough inwardly passing through and respectively piercing through the positive pole clip slot and the negative pole clip slot inside the cylinder like portion. The adapting barrel is formed by a conductive material and as a cylinder shape. A circumference wall of the adapting barrel is formed with a screwing strip as a spiral shape, with a bottom of the screwing strip being a vertical wall. The vertical wall is circularly disposed with a plurality of concave bodies. A top surface of the adapting barrel is formed with an opening and embedded with an insulation body, with the insulation body having a joining groove vertically penetrating. A sheet body of the positive pole clip is formed with an extension and a bending. The positive pole clip obliquely protrudes to form a fasten piece, with a bottom formed into a clamp line end. A sheet body of the negative pole clip is formed with an extension and a bending. The negative pole clip obliquely protrudes to form a fasten piece, with a bottom formed into a clamp line end. The joining body is formed by a conductive material to have a top cover showing an arc shape and a joining lever downwardly stretching. The top cover covers the opening of the adapting barrel. An external diameter of the joining lever equals an inner diameter of the joining groove. When assembling, the positive pole clip is downwardly accommodated into the positive pole clip slot from the top opening of the main body, so that the clamp line end of the positive pole clip aligns with one of the set of inserting troughs. The fasten piece of the positive pole clip and the positive pole clamp slot achieve fastening and positioning. The negative pole clip is downwardly accommodated into the negative pole clip slot, so that the clamp line end of the negative pole clip aligns with another of the set of inserting troughs. The fasten piece of the negative pole clip and the negative pole clip slot achieve fastening and positioning. After positioning the negative pole clip, its top section stretches from the notch of the cylinder like portion. The adapting barrel downwardly fits with the cylinder like portion to enable the screwing strip of the adapting barrel to exist on the straight-type external surface of the cylinder like portion. The vertical wall is downwardly and vertically disposed from the shield ring of the cylinder like portion. The plurality of concave bodies of the adapting barrel is fastened into the corresponding slot of the cylinder like portion one on one, so that the adapting barrel and the cylinder like portion achieve a combination. In the process, a top section of the negative pole clip achieves electric conductance together with the adapting barrel. At the same time, a top section of the positive pole clip enters the joining groove of the insulation body at a top end of the adapting barrel. Finally, the joining lever of the joining body pierces through the joining groove of the insulation body from an outside, with the joining lever being in contact with the top section of the positive pole clip, so that the joining lever and the joining groove perform a packing motion, achieving electric conductance together with the top section of the positive pole clip. At the same time, the top cover completely covers the top opening of the adapting barrel.

According to the above mentioned plug-in power source adapting seat, each of the plurality of concave bodies of the adapting barrel is a concave body as a triangle formed and recessed by stamping an originally horizontal wall.

DETAILED DESCRIPTION OF THE PREFERRED EMBODIMENTS

The technical characteristics, contents, advantages and effects of the present invention will be apparent with the detailed description of preferred embodiments accompanied with related drawings as follows.

Figure 1:
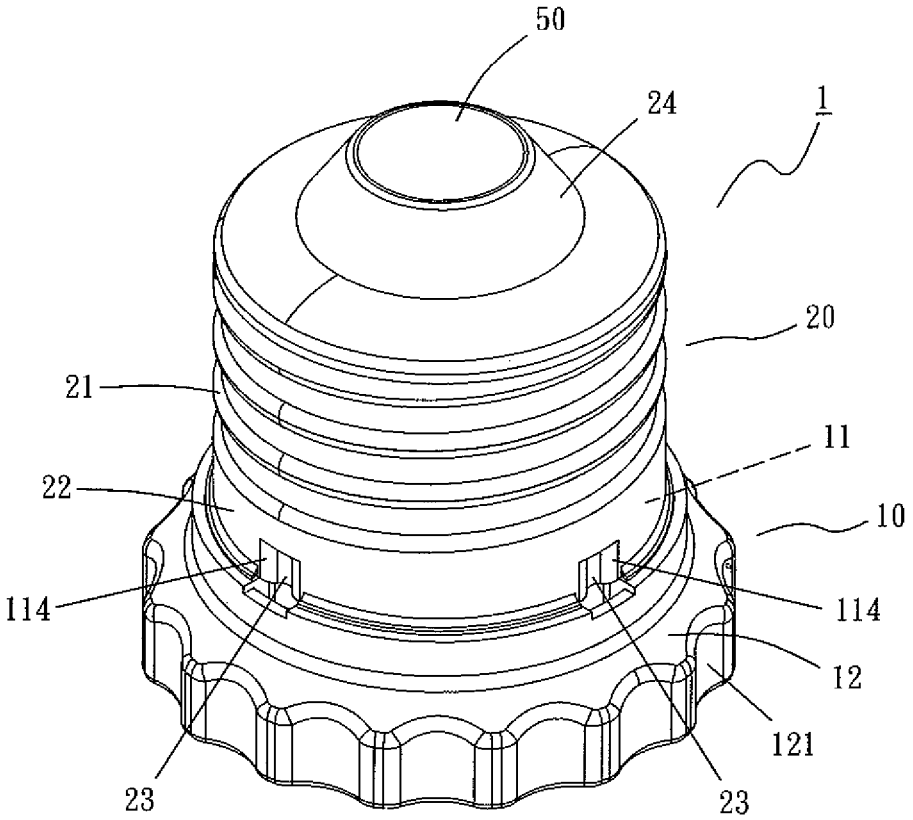
FIG. 1 is a three-dimensional drawing according to the embodiment of the present invention.
Figure 2:
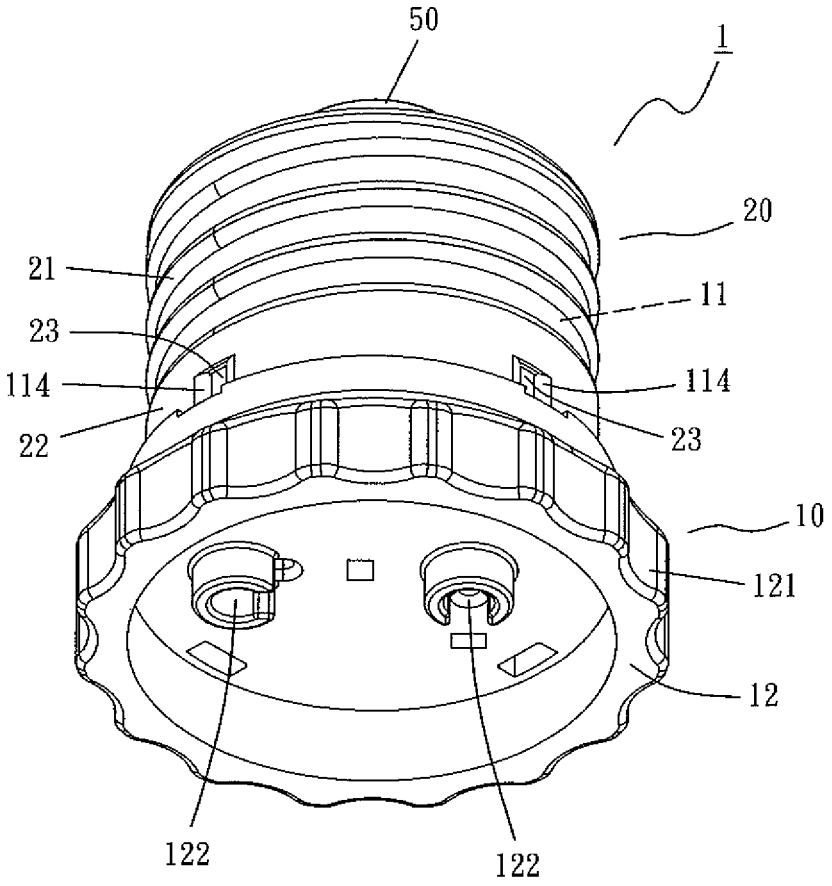
FIG. 2 is a three-dimensional drawing of another viewing angle according to the embodiment of the present invention.
Figure 3:
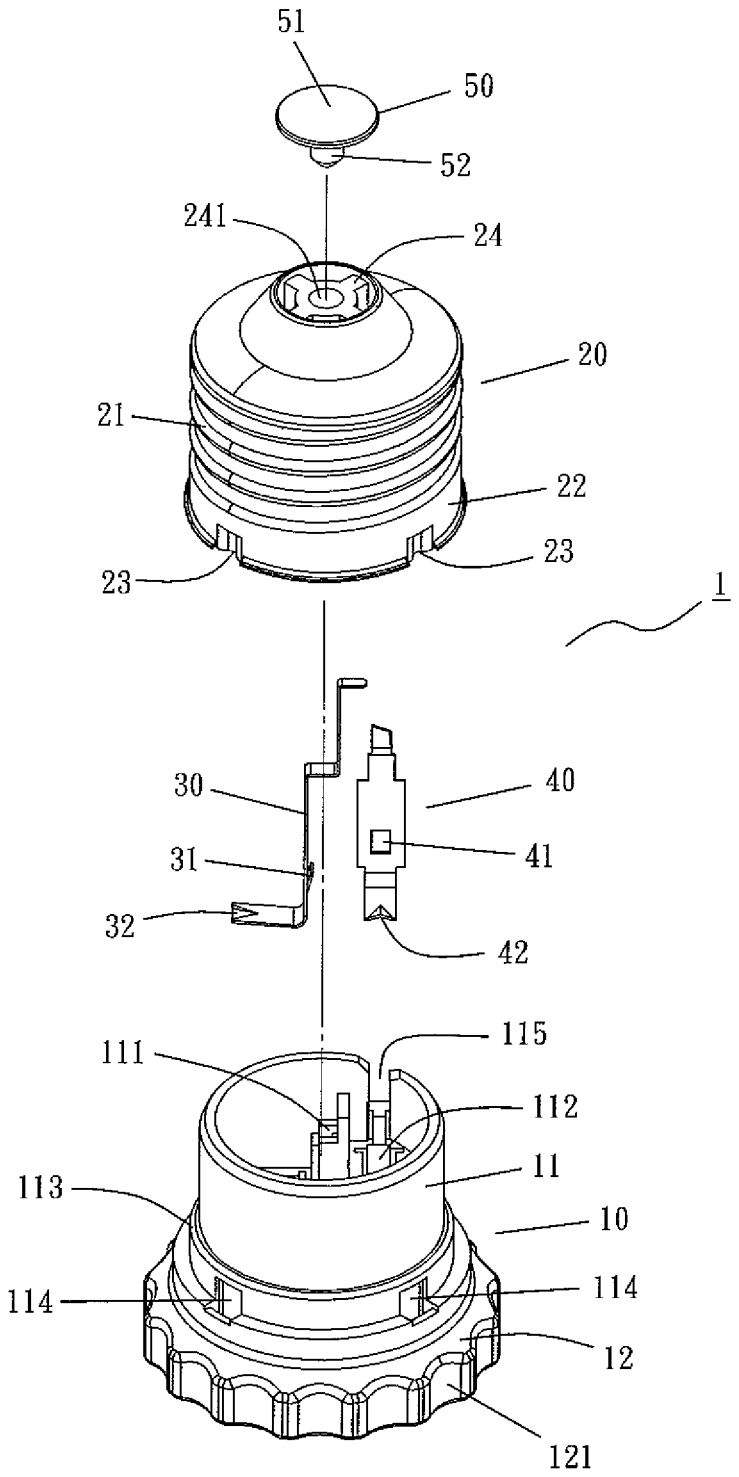
FIG. 3 is a three-dimensional decomposition drawing according to the embodiment of the present invention.
Figure 4:
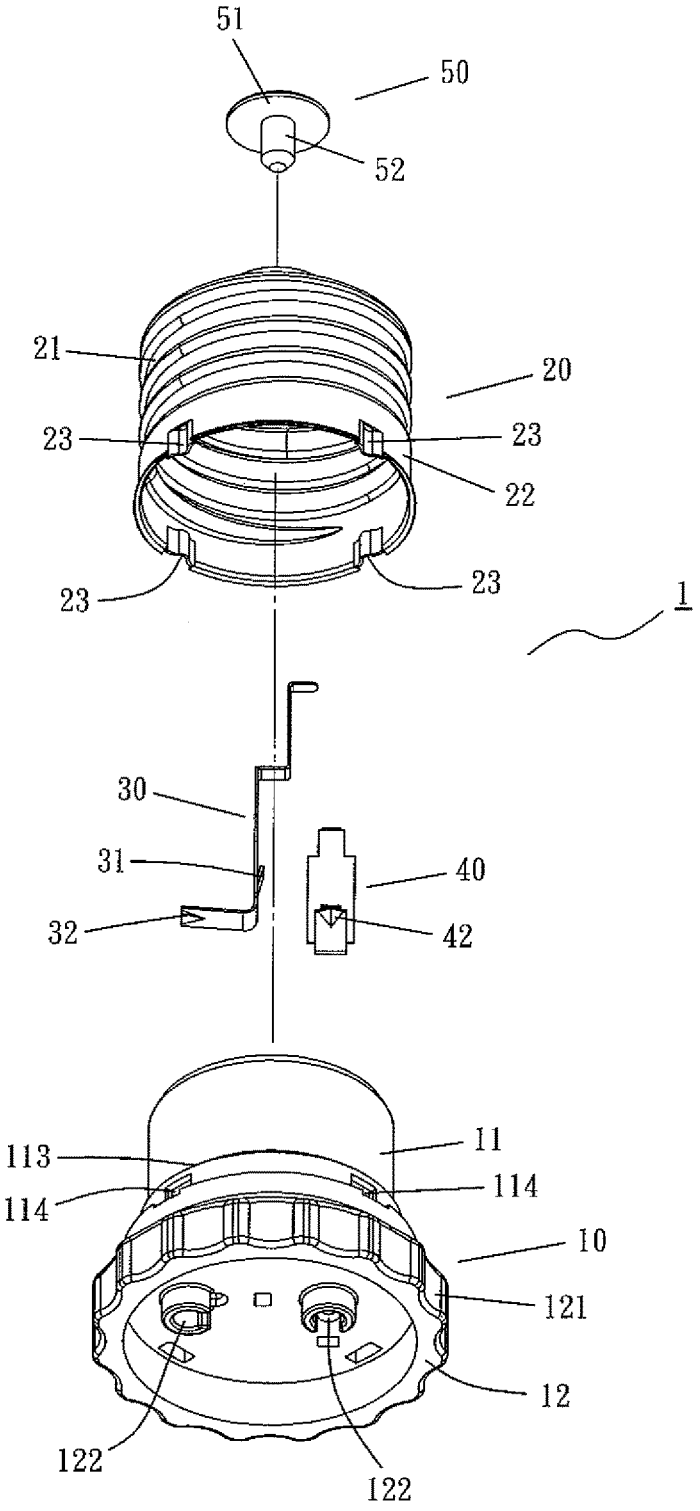
FIG. 4 is a three-dimensional decomposition drawing at another viewing angle according to the embodiment of the present invention.
Figure 5:
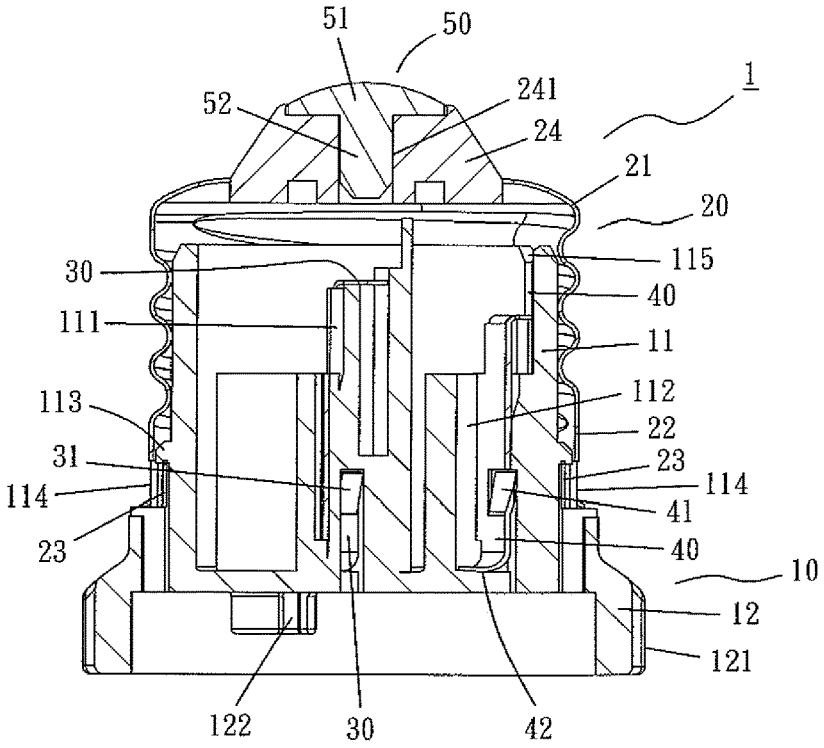
FIG. 5 is a combined cross-sectional drawing according to the embodiment of the present invention.
Figure 6:
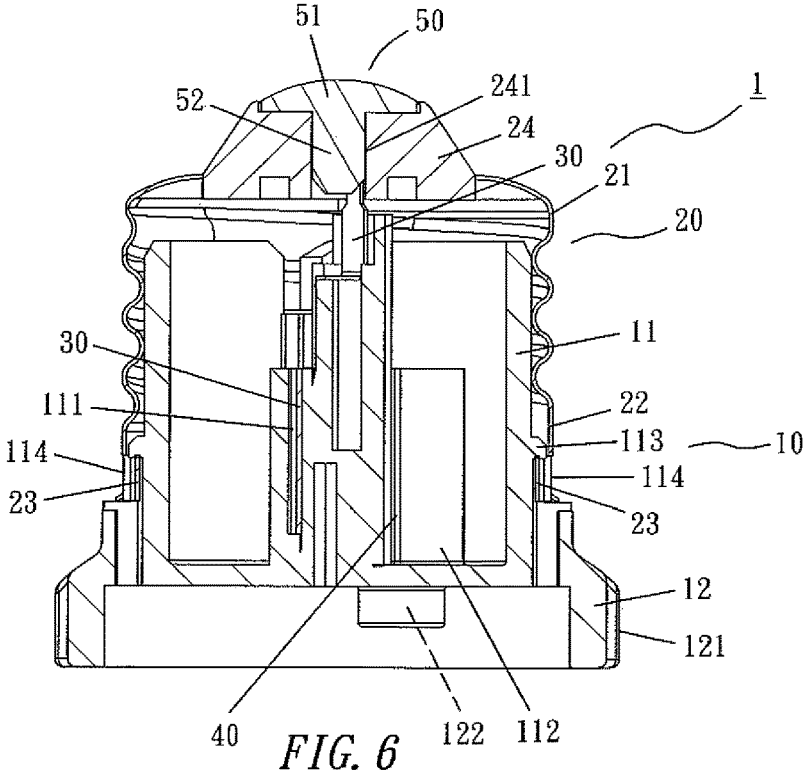
FIG. 6 is a combined cross-sectional drawing at another viewing angle according to the embodiment of the present invention.

The embodiment of the present invention is a power source adapter seat 1, and the appearance is shown in FIGS. 1-2. The structure decomposition is shown in FIGS. 3, 4 and composed of a main body 10, an adapting barrel 20, a positive pole clip 30, a negative pole clip 40 and a joining body 50.

With reference to FIGS. 3-6, the main body 10 is integrally formed by a cylinder like portion 11 and a disc like portion 12. The cylinder like portion 11 is shown as being of the straight-type, the outward appearance is a smooth surface, the top surface is opened, and the inside is disposed with a positive pole clip slot 111 and a negative pole clip slot 112 (shown in FIGS. 3, 5, 6), which are isolated, to accommodate and position the positive pole clip 30 and the negative pole clip 40. The outward appearance of the cylinder like portion 11 is formed with a shield ring 113 at a small distance away from its bottom of the cylinder like portion 11, its bottom is circularly disposed with a plurality of slots 114 (for example, it is uniformly divided into four), and its circumference wall is disposed with a notch 115. The disc like portion 12 is formed on the bottom surface of the cylinder like portion 11 to form an enlarged area, and the enlarged area includes an irregular outer ring 121 which force can be easily applied on. The disc like portion 12 is formed with a set of inserting troughs 122 (shown in FIGS. 2, 4). The inserting troughs 122 communicate toward inside and respectively pierce through the positive pole clip slot 111 and the negative pole clip slot 112 inside the cylinder like portion 11.

The adapting barrel 20 is formed by conductive material and as a cylinder shape, and its circumference wall is formed with a screwing strip 21 as a spiral shape. The bottom of the screwing strip 21 is a vertical wall 22. The vertical wall 22 is circularly disposed with a plurality of concave bodies 23 (for example, it is uniformly divided into four). The concave bodies 23, as a triangle, are recessed and formed by stamping an originally horizontal wall body. The number and position of the concave bodies 23 correspond to the slots 114 of the cylinder like portion 11. The top surface intermediate of the adapting barrel 20 is formed with an opening to embed an insulation body 24. The insulation body 24 has a joining groove 241 vertically penetrating and located intermediate its ends. The sheet body of the positive pole clip 30 is is formed with a necessary extension and bending, and its intermediate portion is obliquely protruded to form a fasten piece 31, and its bottom is finally formed into a clamp line end 32. The sheet body of the negative pole clip 40 is formed with a necessary extension and bending, its intermediate portion is obliquely protruded to form a fasten piece 41, and its bottom is finally formed into a clamp line end 42. The joining body 50 is formed by a conductive material to have a top cover 51 formed with an arc shape and a joining lever 52 downwardly stretched. The top cover 51 sufficiently covers the top opening of the adapting barrel 20. The external diameter of the joining lever 52 equals the inner diameter of the joining groove 241 of the insulation body 24.

While assembling, firstly, the positive pole clip 30 is downwardly accommodated into the positive pole clip slot 111 from the top opening of the main body 10. Finally, the clamp line end 32 aligns one of the inserting troughs 122, and the fasten piece 31 and the positive pole clip slot 111 achieve fastening and positioning. Next, the negative pole clip 40 is downwardly accommodated into the negative pole clip slot 112. Finally, the clamp line end 42 aligns another inserting trough 122, and the fasten piece 31 and the negative pole clip slot 112 achieve fastening and positioning. After positioning the negative pole clip 40, its top section would exactly stretch from the notch 115 of the cylinder like portion 11 (shown in FIG. 5). Next, the adapting barrel 20 is downwardly fit on the cylinder like portion 11 to enable the screwing strip 21 of the adapting barrel 20 to exist on the straight-type external surface of the cylinder like portion 11. The vertical wall 22 vertically downwardly extends from the shield ring 113 of the cylinder like portion 11. Afterward the concave bodies 23 of the adapting barrel 20 fasten into the correspondingly slot 114 of the cylinder like portion 11 one on one, so that the adapting barrel 20 and the cylinder like portion 11 achieve a stable combination. In the process, the top section of the negative pole clip 40 achieves electric conductance together with the adapting barrel 20 (shown in FIG. 5) while stretching out of the notch 115. At the same time, due to the position design, the top section of the positive pole clip 30 would enter the joining groove 241 of the insulation body 24 at the top end of the adapting barrel 20 to stay. Finally, the joining lever 52 of the joining body 50 pierces through the joining groove 241 of the insulation body 24 from the outside. The joining lever 52 is in contact with the top section of the positive pole clip 30, so that when the joining lever 52 and the joining groove 241 perform a packing motion, it will achieve electric conductance together with the top section of the positive pole clip 30 (shown in FIG. 6). At the same time, the top cover 51 completely covers the top opening of the adapting barrel 20. Accordingly, the whole power source adapting seat 1 can be completely assembled.

Figure 7:
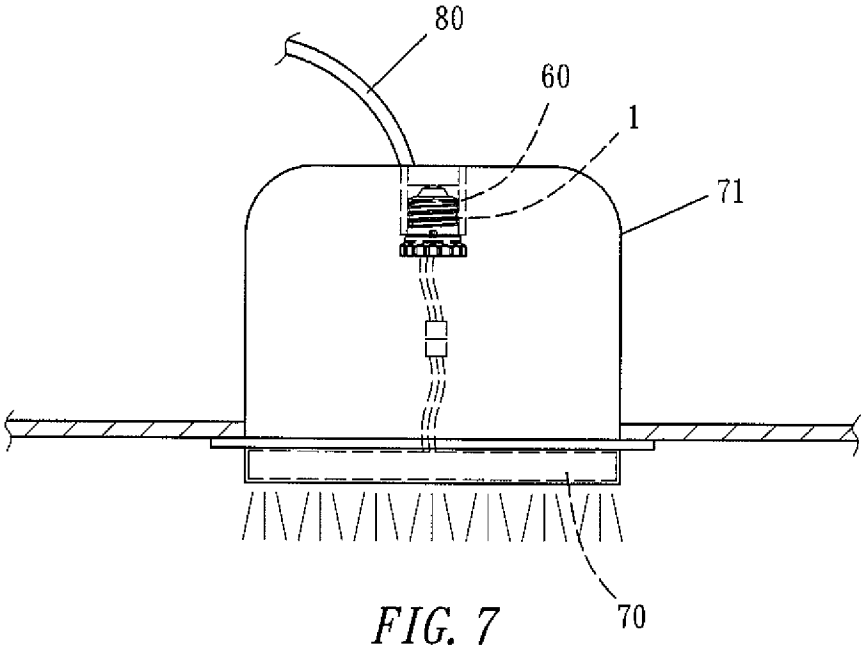
FIG. 7 is a use schematic diagram of combining a conventional lamp seat according to the present invention.

The use of the power source adapting seat 1, for example, is shown in FIG. 7. The power source adapting seat 1 is screwed into a screwing portion (the interface of the model number: E26/E27) of the conventional lamp seat 60 through the screwing strip 21 on the circumference wall of the adapting barrel 20, so that the whole power source adapting seat 1 and the conventional lamp seat 60 achieve a screwing combination. Moreover, the top surface of the top cover 51 of the power source adapting seat 1 conducts the positive pole inside the conventional lamp seat 60, and the adapting barrel 20 conducts the negative pole inside the conventional lamp seat 60 since it is in contact with the screwing portion of the conventional lamp seat 60. The positive and negative poles of the power line 80 are conducted to the positive and negative pole clips 30, 40 by respectively passing through the top cover 51 and the adapting barrel 20. When two naked ends of the power line of a flat LED luminous member 70 stably inside the opening surface of the conventional lamp housing 71 are respectively inserted into the inserting trough 122 of the power source adapter seat 1, the two naked ends respectively touch the clamp line end 32 of the positive pole clip 30 and the clamp line end 42 of the negative pole clip 40. When force is slightly imposed to push, the two naked ends would respectively press the correspondingly clamp line ends 32, 42 to inwardly bend, so that the two naked ends are allowed to respectively pass through the clamp line ends 32, 42 to enter the positive pole clip slot 111 and the negative pole clip slot 112 for staying. When the force is not imposed to push, the two clamp line ends 32, 42 would co-clamp the two naked ends together with the inner wall of the positive pole clip slot 111 and the negative pole clip slot 112 due to the material having a resilience effect, such that it is unable to randomly come off. Furthermore, the positive and negative poles of the power source is conducted to the LED luminous member 70 to supply power for emitting light.

Accordingly, the present invention mainly establishes a power source adapting seat 1 to be screwed into the screwing portion of the conventional lamp seat 60 to allow the whole power source adapting seat 1 and the conventional lamp seat 60 to achieve a screwing combination. Moreover, the power of the conventional lamp seat 60 is conducted to the power source adapting seat 1. Afterward the power source adapting seat 1 can be plugged and conducted by power lines of other electric appliances to supply power to the other electric appliances. At the same time, the two naked ends of the power line would be respectively and stably clamped by the two clamp line ends 32, 42 while performing plugging and conduction for the power source adapting seat 1, so that the power line is unable to randomly come off, thereby achieving the intend purpose of exactly plugging and combining the power line without loosening and separating even if an external force is imposed.

While the present invention has been described by means of specific embodiments, numerous modifications and variations could be made thereto by those skilled in the art without departing from the scope and spirit of the invention set forth in the claims.

What is claimed is:

1. A plug-in power source adapting seat composed of a main body, an adapting barrel, a positive pole clip, a negative pole clip and a joining body, wherein:

the main body is integrally formed by a cylinder like portion and a disc like portion, the cylinder like portion has a straight-type external surface, the top surface of the cylinder like portion is opened, an inside of the cylinder like portion is disposed with a positive pole clip slot and a negative pole clip slot, an outward appearance of the cylinder like portion is formed with a shield ring at a small distance away from a bottom of the cylinder like portion, the bottom is circularly disposed with a plurality of slots, a circumference wall is disposed with a notch; the disc like portion is formed at the bottom of the cylinder like portion and formed with an expanded area, the bottom of the disc like portion is formed with a set of inserting troughs, the set of inserting troughs inwardly passing through and respectively piercing through the positive pole clip slot and the negative pole clip slot inside the cylinder like portion;

the adapting barrel is formed by a conductive material and has a cylinder shape, a circumference wall of the adapting barrel is formed with a screwing strip as a spiral shape, a bottom of the screwing strip is a vertical wall, the vertical wall is circularly disposed with a plurality of concave bodies, a top surface of the adapting barrel is formed with an opening and is embedded with an insulation body, the insulation body has a joining groove vertically penetrating;

a sheet body of the positive pole clip is formed with an extension and a bending, the positive pole clip obliquely protrudes to form a fasten piece, and a bottom of the positive pole clip is formed into a clamp line end;

a sheet body of the negative pole clip is formed with an extension and a bending, the negative pole clip obliquely protrudes to form a fasten piece, and a bottom of the negative pole clip is formed into a clamp line end; and the joining body is formed by a conductive material to have a top cover showing an arc shape and a joining lever downwardly stretching, the top cover covers the opening of the adapting barrel, and an external diameter of the joining lever equals an inner diameter of the joining groove;

in assembling, the positive pole clip is downwardly accommodated into the positive pole clip slot from a top opening of the main body so that the clamp line end of the positive pole clip aligns with one of the set of inserting troughs, with the fasten piece of the positive pole clip and the positive pole clip slop achieving fastening and positioning; the negative pole clip is downwardly accommodated into the negative pole clip slot so that the clamp line end of the negative pole clip aligns with another of the set of inserting troughs, the fasten piece of the negative pole clip and the negative pole clip slot achieves fastening and positioning, after positioning the negative pole clip, a top section of the negative pole clip stretches from the notch of the cylinder like portion; the adapting barrel downwardly fits the cylinder like portion to enable the screwing strip of the adapting barrel to exist on the straight-type external surface of the cylinder like portion, the vertical wall is downwardly and vertically disposed from the shield ring of the cylinder like portion, the plurality of concave bodies of the adapting barrel is fastened into a corresponding slot of the cylinder like portion one on one so that the adapting barrel and the cylinder like portion achieve a combination, in the process, the top section of the negative pole clip achieves electric conductance together with the adapting barrel, at the same time, a top section of the positive pole clip enters the joining groove of the insulation body at a top end of the adapting barrel, the joining lever of the joining body pierces through the joining groove of the insulation body from an outside, the joining lever is in contact with the top section of the positive pole clip, the joining lever and the joining groove performing a packing motion, achieve an electric conductance together with the top section of the positive pole clip, and at the same time, the top cover completely covers the opening of the adapting barrel.

2. The plug-in power source adapting seat of claim 1, wherein the disc like portion has an external ring that is imposed with force to rotate.

3. The plug-in power source adapting seat of claim 1, wherein each of the the plurality of concave bodies of the adapting barrel is a concave body as a triangle formed and recessed by stamping an originally horizontal wall.

4. The plug-in power source adapting seat of claim 1, wherein a number and position of the plurality of concave bodies of the adapting barrel correspond to the plurality of slots of the cylinder like portion.

* * * * *